US010901334B2

(12) United States Patent
Watanabe

(10) Patent No.: US 10,901,334 B2
(45) Date of Patent: Jan. 26, 2021

(54) MAGENTA TONER

(71) Applicant: ZEON CORPORATION, Tokyo (JP)

(72) Inventor: Masashi Watanabe, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 16/628,389

(22) PCT Filed: Jul. 12, 2018

(86) PCT No.: PCT/JP2018/026397
§ 371 (c)(1),
(2) Date: Jan. 3, 2020

(87) PCT Pub. No.: WO2019/013302
PCT Pub. Date: Jan. 17, 2019

(65) Prior Publication Data

US 2020/0218172 A1 Jul. 9, 2020

(30) Foreign Application Priority Data

Jul. 14, 2017 (JP) ..... 2017-138230

(51) Int. Cl.
*G03G 9/00* (2006.01)
*G03G 9/09* (2006.01)

(52) U.S. Cl.
CPC ..... *G03G 9/0906* (2013.01); *G03G 9/092* (2013.01)

(58) Field of Classification Search
CPC ..... G03G 9/0906; G03G 9/092
USPC ..... 430/108.21, 107.1
See application file for complete search history.

(56) References Cited

U.S. PATENT DOCUMENTS

2019/0243268 A1* 8/2019 Watanabe ..... G03G 9/08711

FOREIGN PATENT DOCUMENTS

JP S63-129354 A 6/1988
JP S63-129355 A 6/1988
JP 2000-347458 A 12/2000
JP 2004-61686 A 2/2004
JP 2007-286148 A 11/2007
JP 2014-59398 A 4/2014

OTHER PUBLICATIONS

Notification of Transmittal of Translation of the International Preliminary Report on Patentability (Form PCT/IB/338) issued in counterpart International application No. PCT/JP2018/026397 dated Jan. 23, 2020 with Forms PCT/IB/373 and PCT/ISA/237. (5 pages).

* cited by examiner

*Primary Examiner* — Mark A Chapman
(74) *Attorney, Agent, or Firm* — Westerman, Hattori, Daniels & Adrian, LLP

(57) ABSTRACT

Provided is a magenta toner which exhibits high image density and chroma, has excellent low-temperature fixability, shelf stability and charging ability, is unlikely to fog, and can be produced at low cost. The magenta toner contains a binder resin and a magenta colorant, wherein the magenta toner contains C.I. Pigment Red 122, C.I. Pigment Violet 19 and a compound A represented by the following general formula (1) as the magenta colorant, and wherein, with respect to 100 parts by mass of the binder resin, a total of from 3 to 30 parts by mass of the C.I. Pigment Red 122, the C.I. Pigment Violet 19 and the compound A are contained, and a mass ratio of a total content of the C.I. Pigment Red 122 and the C.I. Pigment Violet 19 to a content of the compound A {(PR122+PV19)/the compound A} is from 1 to 20:

General Formula (1)

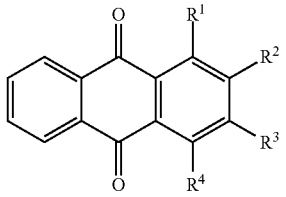

3 Claims, No Drawings

MAGENTA TONER

TECHNICAL FIELD

The present disclosure relates to a magenta toner for developing an electrostatic latent image formed by electrophotography, electrostatic recording, etc.

BACKGROUND ART

In image forming devices such as an electrophotographic device and an electrostatic recording device, an electrostatic latent image to be formed on a photo conductor is first developed with a toner. Subsequently, a formed toner image is transferred onto a transfer material such as paper if required, and then fixed by various methods such as heating, pressurization or solvent vapor.

In such image forming devices, digital full color copying machines and digital full color printers have been put to practical use. In digital full color copying machines, a color image original is color-separated by each of color filters of blue, green and red, and then electrostatic latent images having a dot diameter of from 20 μm to 70 μm corresponding to the color original are developed using each of toners of yellow, magenta, cyan and black, and a full color image is formed utilizing an action of subtractive color mixing.

In recent years, a demand for higher image quality and higher definition of the full color image has been increasing. In particular, in order to improve color reproducibility, it is desired that printing can be performed with the same hue as printing with ink.

Conventionally, it is known that, for a magenta toner, for example, a quinacridone pigment, a thioindigo pigment, a xanthene pigment, a monoazo pigment, a perylene pigment, and a diketopyrrolopyrrole pigment are used solely or in a mixed state. Among them, a combination use of the quinacridone pigment with the other magenta pigment is investigated in the viewpoint of excellent weather resistance, thermal resistance and transparency.

Patent Literature 1 discloses a magenta toner containing C.I. Pigment Red 122 and C.I. Pigment Red 185. Patent Literature 2 discloses a magenta toner containing C.I. Pigment Red 122, C.I. Pigment Violet 19, and C.I. Pigment Red 185.

In addition to the combination of magenta pigments, examples of attempt to improve toner characteristics by combining a magenta pigment and a magenta dye are known.

Patent Literature 3 proposes a magenta toner containing a quinacridone colorant and an oil-soluble dye, and discloses a magenta toner containing C.I. Pigment Red 122 and another colorant in Examples.

Patent Literature 4 proposes a magenta toner containing a colorant combinedly using a dye and a pigment, and discloses a magenta toner containing C.I. Pigment Red 122 and C.I. Disperse Violet 26 in Examples.

Patent Literatures 5 and 6 disclose magenta toners containing C.I. Disperse Violet 31 and another colorant.

CITATION LIST

Patent Literature

Patent Literature 1: Japanese Patent Application Laid-Open (JP-A) No. 2014-59398

Patent Literature 2: JP-A No. 2004-61686

Patent Literature 3: JP-A No. 2007-286148

Patent Literature 4: JP-A No. 2000-347458

Patent Literature 5: JP-A No. S63-129355

Patent Literature 6: JP-A No. S63-129354

SUMMARY OF INVENTION

Technical Problem

In recent years, applications of an electrophotographic image forming device have been extended from those used to print or simply copy office documents as general copying machines and printers, to those used to prepare printed matters for use outside the office. Examples of the printed matters outside the office include light printing such as print-on-demand (POD). This POD is a technology made possible by printing variable information based on electronic data.

In such a wide range of applications, the level of demand required of the image density and chroma of printed matters by an electrophotographic image forming device has been rapidly increased in recent years.

The magenta toners disclosed in Patent Literatures 1 and 2 tend to show a low image density, and need to use a large amount of a pigment, and involve a high cost. One of the reasons is considered that when the C.I. Pigment Red 185 and the C.I. Pigment Red 122 are combined, the image density of the printed matter tends to be low.

On the other hand, the dyes used in Patent Literatures 3 to 6 have properties of being dissolvable in a solvent and weak to light, different from pigment. Therefore, when combining the dye and the pigment, in a case where a content ratio of the dye is excessively large, there exists a problem that light resistance is deteriorated. Accordingly, content ratios of the dye and the pigment are self-restricted.

An object of the present disclosure is to provide a magenta toner which exhibits high image density and chroma, has excellent low-temperature fixability, shelf stability and charging ability, is unlikely to fog, and can be produced at low cost.

Solution to Problem

As a result of an extensive study to achieve the object, the present researcher has found that a magenta toner which exhibits high image density and chroma, has excellent low-temperature fixability, shelf stability and charging ability, is unlikely to fog, and can be produced at low cost is obtained, by using C.I. Pigment Red 122, C.I. Pigment Violet 19 and a compound A having the specific chemical structure in combination as a magenta colorant, and thus accomplished the present invention.

That is, a magenta toner of the present disclosure contains a binder resin and a magenta colorant, wherein the magenta toner contains C.I. Pigment Red 122, C.I. Pigment Violet 19 and a compound A represented by the following general formula (1) as the magenta colorant, and wherein, with respect to 100 parts by mass of the binder resin, a total of from 3 to 30 parts by mass of the C.I. Pigment Red 122, the C.I. Pigment Violet 19 and the compound A are contained, and a mass ratio of a total content of the C.I. Pigment Red 122 and the C.I. Pigment Violet 19 to a content of the compound A {(PR122+PV19)/the compound A} is from 1 to 20:

General Formula (1)

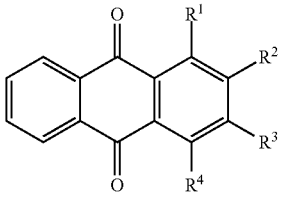

wherein $R^1$ and $R^4$ are each independently an amino group or a hydroxyl group, and $R^2$ and $R^3$ are each independently a hydrogen atom, a halogen atom, or a substituted or unsubstituted phenoxy group ($—OC_6H_5$).

In the present disclosure, it is preferable that the magenta colorant contains a mixed crystal of the C.I. Pigment Red 122 and the C.I. Pigment Violet 19, and the compound A.

In the present disclosure, it is preferable that the compound A is C.I. Solvent Violet 59.

Advantageous Effects of Invention

According to the present invention as described above, a magenta toner which exhibits high image density and chroma, has excellent low-temperature fixability, shelf stability and charging ability, is unlikely to fog, and can be produced at low cost is provided, by using C.I. Pigment Red 122, C.I. Pigment Violet 19 and the compound A having the chemical structure represented by the general formula (1) in combination as a magenta colorant.

DESCRIPTION OF EMBODIMENTS

A magenta toner of the present disclosure contains a binder resin and a magenta colorant, wherein the magenta toner contains C.I. Pigment Red 122, C.I. Pigment Violet 19 and a compound A represented by the following general formula (1) as the magenta colorant, and wherein, with respect to 100 parts by mass of the binder resin, a total of from 3 to 30 parts by mass of the C.I. Pigment Red 122, the C.I. Pigment Violet 19 and the compound A are contained, and a mass ratio of a total content of the C.I. Pigment Red 122 and the C.I. Pigment Violet 19 to a content of the compound A {(PR122+PV19)/the compound A} is from 1 to 20:

General Formula (1)

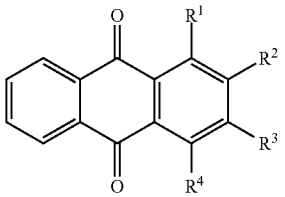

wherein $R^1$ and $R^4$ are each independently an amino group or a hydroxyl group, and $R^2$ and $R^3$ are each independently a hydrogen atom, a halogen atom, or a substituted or unsubstituted phenoxy group ($—OC_6H_5$).

The binder resin is a resin blended with the magenta toner in order to have the shape and functions of the mother particles of the magenta toner.

Hereinafter, the magenta toner of the present disclosure may be simply referred as "toner".

Hereinafter, a production method of magenta colored resin particles which are used in the present disclosure (hereinafter, sometimes simply referred as "colored resin particles"), the magenta colored resin particles obtained by the production method, a production method of a magenta toner using the magenta colored resin particles, and the magenta toner of the present disclosure will be described in sequence.

1. Method for Producing Colored Resin Particles

Generally, methods for producing the colored resin particles are broadly classified into dry methods such as a pulverization method and wet methods such as an emulsion polymerization agglomeration method, a suspension polymerization method and a solution suspension method. The wet methods are preferable since toners having excellent printing characteristics such as image reproducibility can be easily obtained. Among the wet methods, polymerization methods such as the emulsion polymerization agglomeration method and the suspension polymerization method are preferable since toners which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticles with a colorant dispersion, etc. The solution suspension method is a method for producing colored resin particles by forming droplets of a solution in an aqueous medium, the solution containing toner components such as a binder resin and a colorant dissolved or dispersed in an organic solvent, and removing the organic solvent. Both methods can be performed by known methods.

The colored resin particles to be used in the present disclosure can be produced by employing the wet methods or the dry methods. The wet methods are preferable, and the suspension polymerization method is especially preferable among the wet methods. When the suspension polymerization method is employed, the colored resin particles may be produced by the following processes.

(A) Suspension Polymerization Method (A-1) Preparation Process of Polymerizable Monomer Composition First, a polymerizable monomer, a magenta colorant, and in addition, other additives such as a charge control agent and a release agent as well, which are added if required, are mixed to prepare a polymerizable monomer composition. For example, a media type dispersing machine is used for the mixing in preparation of the polymerizable monomer composition.

In the present disclosure, the polymerizable monomer means a monomer having a polymerizable functional group, and a binder resin is made by polymerization of the polymerizable monomer. It is preferable to use a monovinyl monomer as a main component of the polymerizable monomer.

Examples of the monovinyl monomer include styrene; styrene derivatives such as vinyltoluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used solely or in combination of two or more kinds. Among them, it is preferable to use styrene, styrene derivative, derivative of acrylic acid or methacrylic acid as a monovinyl monomer.

In order to improve the hot offset and shelf stability, it is preferable to use any crosslinkable polymerizable monomer together with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids are esterified to an alcohol having two or more hydroxyl groups; other divinyl compounds such as N,N-divinylaniline and divinyl ether; and compounds having three or more vinyl groups. These crosslinkable polymerizable monomers can be used solely or in combination of two or more kinds.

In the present disclosure, it is desirable that the amount of the crosslinkable polymerizable monomer to be used is generally from 0.1 to 5 parts by mass, preferably from 0.3 to 2 parts by mass, with respect to 100 parts by mass of the monovinyl monomer.

Further, the use of a macromonomer as a part of the polymerizable monomer gives rise to a good balance between the shelf stability and low-temperature fixability of the toner. The macromonomer has a polymerizable carbon-carbon unsaturated double bond at the end of the molecular chain and is a reactive oligomer or polymer which usually has a number average molecular weight of from 1,000 to 30,000. It is preferable that the macromonomer can form a polymer having a glass transition temperature (hereinafter sometimes referred as "Tg") higher than that of a polymer obtained by polymerizing a monovinyl monomer.

An used amount of the macromonomer is preferably from 0.03 to 5 parts by mass, more preferably from 0.05 to 1 part by mass with respect to 100 parts by mass of the monovinyl monomer.

In the present disclosure, the magenta colorant contains C.I. Pigment Red 122 (CAS No. 980-26-7), C.I. Pigment Violet 19 (CAS No. 1047-16-1) and a compound A represented by the following general formula (1).

For the C.I. Pigment Violet 19 and the C.I. Pigment Red 122, different raw materials may be used, respectively, or a colorant composition containing them may be used. Examples of the colorant composition include a mixed crystal of the C.I. Pigment Violet 19 and the C.I. Pigment Red 122.

The C.I. Pigment Violet 19 is preferably used in the form of a mixed crystal with the C.I. Pigment Red 122 in order to increase weather resistance and image density. That is, the magenta colorant used in the present disclosure preferably contains a mixed crystal of the C.I. Pigment Red 122 and the C.I. Pigment Violet 19, and the compound A.

The mixed crystal of the C.I. Pigment Violet 19 and the C.I. Pigment Red 122 can be produced by, for example, a method described in U.S. Pat. No. 3,160,510, which is a mixed crystal component is simultaneously recrystallized from sulfuric acid or other suitable solvent and, if necessary, salt-ground and then treated with a solvent, or a method described in DE 1,217,333 B, which is treated with a solvent after cyclization of a substituted diaminoterephthalic acid mixture.

Further, a use ratio of the C.I. Pigment Red 122 and the C.I. Pigment Violet 19 is usually from 80:20 to 20:80, preferably from 70:30 to 30:70, and further preferably from 60:40 to 40:60 in mass ratio.

The compound A used in the present disclosure is a compound having an anthraquinone skeleton represented by the following general formula (1).

General Formula (1)

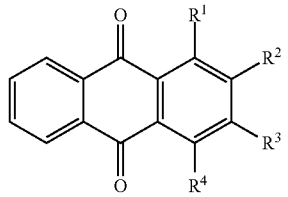

In the general formula (1), $R^1$ and $R^4$ are each independently an amino group or a hydroxyl group. Preferably, $R^1$ and $R^4$ are both amino groups, or one of $R^1$ and $R^4$ is an amino group and the other is a hydroxyl group. More preferably, $R^1$ and $R^4$ are both amino groups.

In the general formula (1), $R^2$ and $R^3$ are each independently a hydrogen atom, a halogen atom, or a substituted or unsubstituted phenoxy group ($—OC_6H_5$). Preferably, at least one of $R^2$ and $R^3$ is an unsubstituted phenoxy group ($—OC_6H_5$), $R^2$ and $R^3$ are both halogen atoms, or $R^2$ and $R^3$ are both hydrogen atoms. More preferably, $R^2$ and $R^3$ are both unsubstituted phenoxy groups ($—OC_6H_5$), or $R^2$ and $R^3$ are both chlorine atoms. Further preferably, $R^2$ and $R^3$ are both unsubstituted phenoxy groups ($—OC_6H_5$).

Hereinafter, examples of the compound A represented by the general formula (1) are given. The compound A used in the present disclosure is not limited to the following specific examples. Also, tautomers of the following specific examples can be preferably used as the compound of the present disclosure.

Formula (1A): C.I. Solvent Violet 59 (CAS No. 6408-72-6)

Formula (1B): C.I. Solvent Violet 31 (CAS No. 81-42-5)

Formula (1C): 1,4-diaminoanthraquinone (CAS No. 128-95-0)

Formula (1D): 1,4-dihydroxyanthraquinone (CAS No. 81-64-1)

Formula (1E): 1-amino-4-hydroxyanthraquinone (CAS No. 116-85-8)

Formula (1F): 1-amino-4-hydroxy-2-phenoxyanthraquinone (CAS No. 17418-58-5)

Formula (1A)

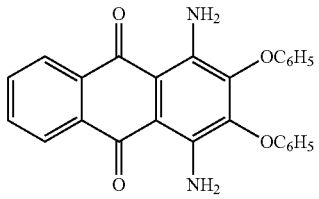

-continued

Formula (1B)

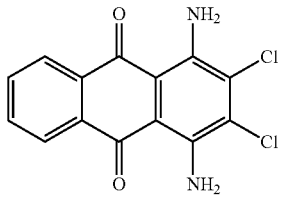

Formula (1C)

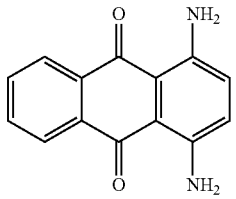

Formula (1D)

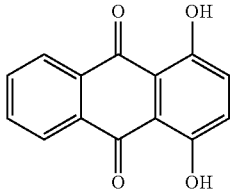

Formula (1E)

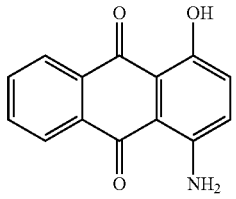

Formula (1F)

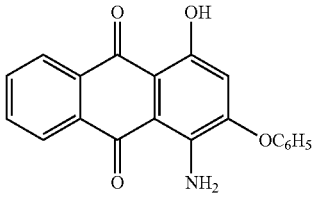

With respect to 100 parts by mass of the binder resin, a total content of the C.I. Pigment Red 122, the C.I. Pigment Violet 19 and the compound A is from 3 to 30 parts by mass, preferably from 4 to 25 parts by mass, more preferably from 5 to 20 parts by mass, and further preferably from 6 to 18 parts by mass.

When the total content of the C.I. Pigment Red 122, the C.I. Pigment Violet 19 and the compound A is from 3 to 30 parts by mass with respect to 100 parts by mass of the binder resin, deterioration in low-temperature fixability is not likely to occur and an intended image density is obtained.

In the present disclosure, a mass ratio of a total content of the C.I. Pigment Red 122 and the C.I. Pigment Violet 19 to a content of the compound A {(PR122+PV19)/the compound A} is from 1 to 20, preferably from 2 to 18, more preferably from 4 to 16, and further preferably from 5 to 14.

In general, dyes have a property of fading easily by ultraviolet rays. Therefore, the mass ratio {(PR122+PV19)/the compound A} is from 1 to 20, whereby the C.I. Pigment Red 122 and the C.I. Pigment Violet 19, and the compound A are contained in a relatively balanced state, thus image density and light resistance can be improved in a balanced manner.

The content of the C.I. Pigment Red 122 is preferably from 1 to 28 parts by mass, more preferably from 2 to 15 parts by mass, and further preferably from 3 to 8 parts by mass, with respect to 100 parts by mass of the binder resin. When the content of the C.I. Pigment Red 122 is from 1 to 28 parts by mass with respect to 100 parts by mass of the binder resin, both decrease in image density and deterioration in low-temperature fixability are not likely to occur.

The content of the C.I. Pigment Violet 19 is preferably from 1 to 28 parts by mass, more preferably from 2 to 15 parts by mass, and further preferably from 3 to 8 parts by mass, with respect to 100 parts by mass of the binder resin. When the content of the C.I. Pigment Violet 19 is from 1 to 28 parts by mass with respect to 100 parts by mass of the binder resin, both decrease in image density and deterioration in low-temperature fixability are not likely to occur When the C.I. Pigment Red 122 and the C.I. Pigment Violet 19 form a mixed crystal, a value obtained by multiplying a mixed crystal content (parts by mass) with respect to 100 parts by mass of the binder resin by a content ratio of each pigment contained in the mixed crystal is regarded as a content (parts by mass) of the pigment.

The content of the compound A is preferably from 0.5 to 12 parts by mass, more preferably from 0.7 to 8 parts by mass, and further preferably from 1.0 to 4 parts by mass, with respect to 100 parts by mass of the binder resin. When the content of the compound A is 0.5 to 12 parts by mass with respect to 100 parts by mass of the binder resin, poor light resistance is not likely to occur and an intended chroma is obtained.

In order to improve the charging ability of the toner, a charge control agent having positively charging ability or negatively charging ability can be used as another additive.

The charge control agent is not particularly limited as long as it is generally used as a charge control agent for toner. Among charge control agents, a charge control resin having positively charging ability or negatively charging ability is preferable since the charge control resin is highly compatible with the polymerizable monomer and can impart stable charging ability (charge stability) to the toner particles, and in the present disclosure, it can improve dispersibility of the colorant. From the viewpoint of obtaining a negatively-chargeable toner, the charge control resin having negatively charging ability is more preferably used.

Examples of the charge control agent having positively charging ability include nigrosine dyes, a quaternary ammonium salts, triaminotriphenylmethane compounds, imidazole compounds, and in addition, charge control resins to be preferably used such as polyamine resins, quaternary ammonium group-containing copolymers and quaternary ammonium salt group-containing copolymers as well.

Examples of the charge control agent having negatively charging ability include azo dyes containing metals such as Cr, Co, Al and Fe, salicylic acid metal compounds and alkyl salicylic acid metal compounds, and in addition, charge control resins to be preferably used such as sulfonic acid group-containing copolymers, sulfonic acid salt group-containing copolymers, carboxylic acid group-containing copolymers and carboxylic acid salt group-containing copolymers as well.

The weight average molecular weight (Mw) of the charge control resin is a polystyrene equivalent molecular weight measured by gel permeation chromatography (GPC) using tetrahydrofuran. It is preferably in a range of from 5,000 to 30,000, more preferably in a range of from 8,000 to 25,000, and still more preferably in a range of from 10,000 to 20,000.

A copolymerization ratio of a monomer having a functional group such as a quaternary ammonium group or a sulfonate group in the charge control resin is in the range of from 0.5 to 12% by mass, preferably in the range of from 1.0 to 6% by mass, and more preferably in the range of from 1.5 to 3% by mass.

In the present disclosure, the charge control agent is used in an amount of, generally from 0.01 to 10 parts by mass, preferably from 0.03 to 8 parts by mass with respect to 100 parts by mass of the monovinyl monomer. When the added amount of the charge control agent is from 0.01 to 10 parts by mass, both fog and printing soiling are not likely to occur.

In addition, it is preferable to use a molecular weight modifier as the other additive, when the polymerizable monomer which becomes a binder resin is polymerized.

The molecular weight modifier is not particularly limited as long as it is generally used as a molecular weight modifier for a toner. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used solely or in combination of two or more kinds.

In the present disclosure, the molecular weight modifier is used in an amount of generally from 0.01 to 10 parts by mass, preferably from 0.1 to 5 parts by mass, with respect to 100 parts by mass of the monovinyl monomer.

In addition, it is preferable to use a release agent as the other additives. By adding a release agent, releasability of the toner from a fixing roll during fixing can be improved. The release agent is not particularly limited, as long as it is one that is generally used as a release agent for a toner. Examples of the release agent include: low-molecular-weight polyolefin waxes and modified waxes thereof; natural plant waxes such as jojoba; petroleum waxes such as paraffin; mineral waxes such as ozokerite; synthetic waxes such as Fischer-Tropsch wax; and polyalcohol esters such as dipentaerythritol ester. Of them, polyalcohol esters are preferred since the toner can achieve a balance between shelf stability and low-temperature fixability. These may be used solely or in combination of two or more kinds.

The release agent is used in an amount of preferably from 0.1 to 30 parts by mass, and further preferably from 1 to 20 parts by mass, with respect to 100 parts by mass of the monovinyl monomer.

(A-2) Suspension Process to Obtain Suspension (Droplets Forming Process)

In the present disclosure, the polymerizable monomer composition comprising a polymerizable monomer and a magenta colorant is dispersed in an aqueous medium containing a dispersion stabilizer, and a polymerization initiator is added therein, then the droplets of the polymerizable monomer composition are formed. The method for forming droplets is not particularly limited. The droplets are formed, for example, by means of a device capable of strong stirring such as an in-line type emulsifying and dispersing machine (product name: MILDER; manufactured by Pacific Machinery & Engineering Co., Ltd), and a high-speed emulsification dispersing machine (product name: T. K. HOMOMIXER MARK II; manufactured by PRIMIX Corporation).

Examples of the polymerization initiator include: persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-hexylperoxy-2-ethylbutanoate, diisopropylperoxydicarbonate, di-t-butylperoxyisophthalate and t-butylperoxyisobutyrate. These can be used solely or in combination of two or more kinds. Among them, the organic peroxides are preferably used since they can reduce residual polymerizable monomer and can impart an excellent printing durability.

Among the organic peroxides, preferred are peroxy esters, and more preferred are non-aromatic peroxy esters, i.e. peroxy esters having no aromatic ring, since they have a good initiator efficiency and can reduce a residual polymerizable monomer.

The polymerization initiator may be added after dispersing the polymerizable monomer composition in the aqueous medium and before forming droplets as described above, or may be added to the polymerizable monomer composition before the polymerizable monomer composition is dispersed in the aqueous medium.

The added amount of the polymerization initiator used in the polymerization of the polymerizable monomer composition is preferably from 0.1 to 20 parts by mass, more preferably from 0.3 to 15 parts by mass, still more preferably from 1 to 10 parts by mass, with respect to 100 parts by mass of the monovinyl monomer.

In the present disclosure, the aqueous medium means a medium containing water as a main component.

In the present disclosure, the dispersion stabilizer is preferably added to the aqueous medium. Examples of the dispersion stabilizer include: inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II) hydroxide; and organic compounds including water-soluble polymers such as polyvinyl alcohol, methyl cellulose and gelatin; anionic surfactants; nonionic surfactants; and ampholytic surfactants. These dispersion stabilizers can be used solely or in combination of two or more kinds.

Among the above dispersion stabilizers, colloid of inorganic compounds, particularly colloid of hardly water-soluble metal hydroxide, is preferable. The use of the colloid of inorganic compounds, particularly of hardly water-soluble metal hydroxide makes it possible to narrow a particle size distribution of the colored resin particles and reduce the amount of the dispersion stabilizer remaining after washing, thus the obtained polymerized-toner becomes capable of reproducing clear images, and moreover inhibiting deterioration of environmental stability.

(A-3) Polymerization Process

After the droplets are formed as described in the above (A-2), the obtained aqueous dispersion medium is heated to start polymerization. Thereby, an aqueous dispersion of colored resin particles containing the magenta colorant is formed.

The polymerization temperature of the polymerizable monomer composition is preferably 50° C. or more, more preferably from 60 to 95° C. The polymerization reaction time is preferably from 1 to 20 hours, more preferably from 2 to 15 hours.

The colored resin particles may be used as a polymerized toner as they are or by adding an external additive which is described below. It is preferable to make the so-called core-shell type (or "capsule type") colored resin particle by using the abovementioned colored resin particle as a core layer and forming a shell layer, which is different from the core layer, around the core layer. The core-shell type colored resin particles can take a balance of lowering fixing temperature and prevention of blocking at storage, since the core layer including a substance having a low softening point is covered with a substance having a higher softening point.

A method for producing the above-mentioned core-shell type colored resin particles using the abovementioned colored resin particles is not particularly limited, and they can be produced by any conventional method. The in situ polymerization method and the phase separation method are preferable from the viewpoint of production efficiency.

A method for producing the core-shell type colored resin particles according to the in situ polymerization method will be hereinafter described.

A polymerizable monomer for forming a shell layer (a polymerizable monomer for shell) and a polymerization initiator are added to an aqueous medium in which the colored resin particles are dispersed, followed by polymerization, thereby the core-shell type colored resin particles can be obtained.

As the polymerizable monomer for shell, the abovementioned polymerizable monomer can be similarly used. Among the polymerizable monomers, any monomer which provides a polymer having Tg of more than 80° C. such as styrene, acrylonitrile and methyl methacrylate is preferably used solely or in combination of two or more kinds.

Examples of the polymerization initiator used for polymerization of the polymerizable monomer for shell include: water-soluble polymerization initiators including metal persulfates such as potassium persulfate and ammonium persulfate; and azo-type initiators such as 2,2'-azobis(2-methyl-N-(2-hydroxyethyl)propionamide) and 2,2'-azobis(2-methyl-N-(1,1-bis(hydroxymethyl)-2-hydroxyethyl) propionamide). These polymerization initiators can be used solely or in combination of two or more kinds. The amount of the polymerization initiator is preferably from 0.1 to 30 parts by mass, more preferably from 1 to 20 parts by mass, with respect to 100 parts by mass of the polymerizable monomer for shell.

The polymerization temperature of the shell layer is preferably 50° C. or more, more preferably from 60 to 95° C. The polymerization reaction time is preferably from 1 to 20 hours, more preferably from 2 to 15 hours.

(A-4) Processes of Washing, Filtering, Dehydrating and Drying

It is preferable that the aqueous dispersion of the colored resin particles obtained by the polymerization is subjected to operations including filtering, washing for removing the dispersion stabilizer, dehydrating, and drying by several times as needed after the polymerization, according to any conventional method.

In the washing method, when the inorganic compound is used as the dispersion stabilizer, it is preferable that acid or alkali is added to the aqueous dispersion of colored resin particles, thereby the dispersion stabilizer is dissolved in water and removed. When colloid of hardly water-soluble inorganic hydroxide is used as the dispersion stabilizer, it is preferable that acid is added to adjust pH of the aqueous dispersion of colored resin particles to 6.5 or less. Examples of the acid to be added include inorganic acids such as sulfuric acid, hydrochloric acid and nitric acid, and organic acids such as formic acid and acetic acid. Particularly, sulfuric acid is suitable for high removal efficiency and small impact on production facilities.

The methods for dehydrating and filtering are not particularly limited, and any of various known methods can be used. For example, a centrifugal filtration method, a vacuum filtration method and a pressure filtration method can be used. Also, the drying method is not particularly limited, and any of various methods can be used.

(B) Pulverization Method

In the case of producing the colored resin particles by employing the pulverization method, the following processes are performed.

First, a binder resin, a magenta colorant and other additives such as a charge control agent and a release agent etc., which are added if required, are mixed by means of a mixer such as a ball mill, a V type mixer, FM mixer (: product name, manufactured by NIPPON COKE & ENGINEERING CO., LTD.), a high-speed dissolver, an internal mixer or a fallberg. Next, the above-obtained mixture is kneaded while heating by means of a press kneader, a twin screw kneading machine or a roller. The obtained kneaded product is coarsely pulverized by means of a pulverizer such as a hammer mill, a cutter mill or a roller mill, followed by finely pulverizing by means of a pulverizer such as a jet mill or a high-speed rotary pulverizer, and classifying into desired particle diameters by means of a classifier such as an air classifier or an airflow classifier. Thereby, colored resin particles produced by the pulverization method can be obtained.

Incidentally, the binder resin, the magenta colorant and other additives such as the charge control agent and the release agent etc., which are added if required, used in the abovementioned "(A) Suspension polymerization method" can be used in the pulverization method. In like manner of the colored resin particles obtained by the abovementioned "(A) Suspension polymerization method", the colored resin particles obtained by the pulverization method as well can be used in any method such as the in situ polymerization method to produce the core-shell type colored resin particles.

As the binder resin, other resins which are conventionally and broadly used for a toner can be used. Specific examples of the binder resin used in the pulverization method include polystyrene, styrene-butyl acrylate copolymers, polyester resins and epoxy resins.

2. Colored Resin Particles

The colored resin particles containing the magenta colorant are obtained by the above production method such as (A) Suspension polymerization method or (B) Pulverization method.

Hereinafter, the colored resin particles constituting the toner will be described. The colored resin particles hereinafter include both core-shell type colored resin particles and colored resin particles which are not core-shell type.

The volume average particle diameter (Dv) of the colored resin particles is preferably from 3 to 15 μm, and more preferably from 4 to 12 μm. When the volume average particle diameter (Dv) of the colored resin particles is from 3 to 15 μm, the decrease of a flowability of the toner, the deterioration of transferability, the decrease of image density or the decrease of a resolution of a image is not likely to occur.

As for the colored resin particles, a ratio (Dv/Dn) of the volume average particle diameter (Dv) and the number average particle diameter (Dn) is preferably from 1.0 to 1.3, more preferably from 1.0 to 1.2. When "Dv/Dn" is from 1.0 to 1.3, the decrease of transferability, image density or resolution is not likely to occur. The volume average particle diameter and the number average particle diameter of the colored resin particles can be measured, for example, by means of a particle diameter measuring device (product name: MULTISIZER; manufactured by Beckman Coulter, Inc.), etc.

The average circularity of the colored resin particles of the present disclosure is in a range of, preferably from 0.96 to 1.00, more preferably from 0.97 to 1.00, and still more preferably from 0.98 to 1.00 from the viewpoint of the image reproducibility.

When the average circularity of the colored resin particles is from 0.96 to 1.00, the thin line reproducibility in printing is not likely to deteriorate.

As the toner of the present disclosure, the colored resin particles containing the magenta colorant can be used as they are. From the viewpoint of controlling the charging ability, flowability and shelf stability of the toner, the colored resin particles may be used as a one-component toner by mixing the colored resin particles with the external additives to add the external additives on the surface of the colored resin particles.

The one-component toner may be further mixed and stirred together with carrier particles to make a two-component toner.

The mixer for performing the external addition is not particularly limited as long as it is a mixer capable of add the external additive on the surface of the colored resin particles. For example, the external addition can be performed by means of a mixing machine capable of mixing and stirring, such as FM MIXER (: product name, manufactured by NIPPON COKE & ENGINEERING CO., LTD.), SUPER MIXER (: product name, manufactured by KAWATA Manufacturing Co., Ltd.), Q MIXER (: product name, manufactured by NIPPON COKE & ENGINEERING CO., LTD.), MECHANOFUSION SYSTEM (: product name, manufactured by Hosokawa Micron Corporation) and MECHANOMILL (: product name, manufactured by Okada Seiko Co., Ltd.).

Examples of the external additive include inorganic fine particles comprising any of silica, titanium oxide, aluminum oxide, zinc oxide, tin oxide, calcium carbonate, calcium phosphate and/or cerium oxide; organic fine particles comprising any of polymethyl methacrylate resin, silicone resin and/or melamine resin. Among them, preferred are inorganic fine particles, and among inorganic fine particles, preferred are silica and/or titanium oxide, especially preferred are silica fine particles.

Incidentally, although these external additives may be used solely, it is preferable to use in combination of two or more kinds.

In the present disclosure, it is desirable to use an external additive in a proportion of usually from 0.05 to 6 parts by mass, and preferably from 0.2 to 5 parts by mass with respect to 100 parts by mass of the colored resin particles. When the added amount of the external additive is from 0.05 to 6 parts by mass, both a transfer residue and fog are not likely to occur.

3. Toner of Present Disclosure

The toner of the present disclosure obtained through the processes described above is a magenta toner that uses, as a magenta colorant, C.I. Pigment Red 122, C.I. Pigment Violet 19 and the compound A in combination in specific proportions, thereby having the following effects: the magenta toner exhibits high image density and chroma, has excellent low-temperature fixability, shelf stability and charging ability, is unlikely to fog, and can be produced at low cost.

EXAMPLES

Hereinafter, the present disclosure will be described further in detail with reference to examples and comparative examples. However, the present disclosure is not limited to these examples. Herein, parts and % are on a mass basis unless otherwise noted.

1. Production of Magenta Pigment

Production Example 1

2,5-di-(4-methylphenylamino)terephthalic acid was cyclized in phosphoric acid to synthesize 2,9-dimethylquinacridone (C.I. Pigment Red 122). The obtained phosphoric acid dispersion of 2,9-dimethylquinacridone was added with water, and filtered through a filter, then further washed with water. The washed 2,9-dimethylquinacridone was added again with water to obtain an aqueous dispersion having a solid content of 20%.

Similarly, an aqueous dispersion of quinacridone (C.I. Pigment Violet 19) having a solid content of 20% was prepared using 2,5-di-phenylaminoterephthalic acid. 250 parts of ethanol was added to 250 parts of the aqueous dispersion having a solid content of 20% of dimethylquinacridone (C.I. Pigment Red 122) and 250 parts of the aqueous dispersion having a solid content of 20% of quinacridone (C.I. Pigment Violet 19) to obtain a mixed solution of the pigments. This mixed solution was transferred to a container equipped with a condenser, and reacted under heating and refluxing for 5 hours while grinding the pigment. After completion of the reaction, the pigments were separated by filtration from the reaction solution, washed, dried and then pulverized to obtain a mixed crystal of the magenta pigments (that is, a mixed crystal of the C.I. Pigment Red 122 and the C.I. Pigment Violet 19). Here, a mass ratio of each pigment contained in the mixed crystal was C.I. Pigment Red 122:C.I. Pigment Violet 19=1:1.

2. Production of Colored Resin Particles

<Colored Resin Particles (1)>

2-1. Preparation of Polymerizable Monomer Composition for Core:

73 parts of styrene and 27 parts of n-butyl acrylate, 0.15 parts of divinylbenzene, 0.4 parts of tetraethylthiuram disulfide, and as a magenta colorant, 6.5 parts of the mixed crystal of the magenta pigments of Production Example 1 above and 0.5 parts of C.I. Solvent Violet 59 (the following formula (1A), CAS No. 6408-72-6, manufactured by Clariant, product name: Solvaperm Red Violet R) were wet pulverized using a media-type disperser (product name: Picomill, manufactured by ASADA IRON WORKS. CO., LTD.). To the mixture obtained by wet pulverization, 1.0 part of a charge control resin (quaternary ammonium salt group-containing styrene-acrylic copolymer, copolymerization ratio of monomers having a functional group: 8%) and 9.0 parts of an ester wax (manufactured by NOF Corporation, polyhydric alcohol ester) were added, mixed and dissolved to prepare a polymerizable monomer composition.

Formula (1A)

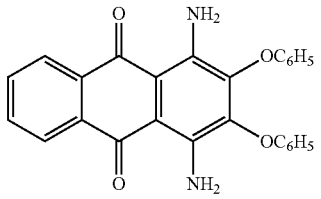

2-2. Preparation of Aqueous Dispersion Medium:

On the other hand, an aqueous solution in which 9.9 parts of sodium hydroxide was dissolved in 50 parts of ion exchanged water was gradually added under stirring to an aqueous solution in which 14.1 parts of magnesium chloride was dissolved in 280 parts of ion exchanged water to prepare a magnesium hydroxide colloidal dispersion.

2-3. Preparation of Polymerizable Monomer for Shell:

On the other hand, 2 parts of methyl methacrylate and 130 parts of water were finely dispersed by means of an ultrasonic emulsifier to prepare an aqueous dispersion of a polymerizable monomer for shell.

2-4. Droplets forming Process:

The polymerizable monomer composition was charged into the magnesium hydroxide colloidal dispersion (magnesium hydroxide colloid amount: 7.2 parts), and the mixture was further stirred, then 4.4 parts of t-butylperoxy-2-ethyl hexanoate was added thereto as a polymerization initiator. The dispersion to which the polymerization initiator had been added was dispersed at a rotation number of 15,000 rpm by an in-line type emulsifying and dispersing machine (manufactured by Pacific Machinery & Engineering Co., Ltd, product name: MILDER) to form droplets of the polymerizable monomer composition.

2-5. Suspension Polymerization Process:

A dispersion containing droplets of the polymerizable monomer composition was placed in a reactor, and the temperature was raised to 90° C. to perform a polymerization reaction. After the polymerization conversion rate reached almost 100%, a solution prepared by dissolving 0.1 part of 2,2'-azobis[2-methyl-N-(2-hydroxyethyl)-propionamide] (product name: VA-086, manufactured by Wako Pure Chemical Industries, Ltd., water-soluble initiator) as a polymerization initiator for shell in the aqueous dispersion of the polymerizable monomer for shell was added to the reactor. Subsequently, polymerization was further continued by maintaining the temperature at 95° C. for 4 hours, and then the reaction was stopped by water cooling to obtain an aqueous dispersion of core-shell type colored resin particles.

2-6. Post-Treatment Process:

The aqueous dispersion of colored resin particles was subjected to acid washing by adding sulfuric acid to the extent that pH comes 6.0 or less while stirring (25° C., 10 minutes), and then the colored resin particles separated by filtration were washed with water, and the wash water was filtered. The electric conductivity of the filtrate at this time was 20 μS/cm. Furthermore, the colored resin particles after the washing and filtration process were dehydrated and dried to obtain dried colored resin particles (1).

<Colored Resin Particles (2)> manner as the method for producing colored resin particles (1) except that, in the "Preparation of Polymerizable Monomer Composition for Core", the added amount of the mixed crystal of the magenta pigments of Production Example 1 was changed from 6.5 parts to 5.5 parts, and the added amount of the C.I. Solvent Violet 59 was changed from 0.5 parts to 1.0 part.

<Colored Resin Particles (3)>

Colored resin particles (3) were obtained in the same manner as the method for producing colored resin particles (1) except that, in the "Preparation of Polymerizable Monomer Composition for Core", the added amount of the mixed crystal of the magenta pigments of Production Example 1 was changed from 6.5 parts to 4.5 parts, and the added amount of the C.I. Solvent Violet 59 was changed from 0.5 parts to 1.5 part.

<Colored Resin Particles (4)>

Colored resin particles (4) were obtained in the same manner as the method for producing colored resin particles (1) except that, in the "Preparation of Polymerizable Monomer Composition for Core", 3.0 parts of C.I. Pigment Red 122 (CAS No. 980-26-7, manufactured by Clariant, product name: Toner Magenta E) and 3.0 parts of C.I. Pigment Violet 19 (CAS No. 1047-16-1, manufactured by Clariant, product name: Ink Jet Magenta E5B02) were used instead of 6.5 parts of the mixed crystal of the magenta pigments of Production Example 1, and the added amount of the C.I. Solvent Violet 59 was changed from 0.5 parts to 1.0 part.

<Colored Resin Particles (5)>

Colored resin particles (5) were obtained in the same manner as the method for producing colored resin particles (1) except that, in the "Preparation of Polymerizable Monomer Composition for Core", 0.5 parts of C.I. Solvent Violet 31 (the following formula (1B), CAS No. 81-42-5) was used instead of 0.5 parts of the C.I. Solvent Violet 59.

Formula (1B)

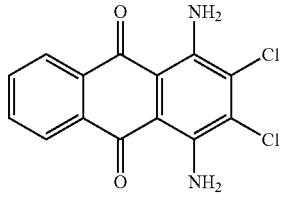

<Colored Resin Particles (6)>

Colored resin particles (6) were obtained in the same manner as the method for producing colored resin particles (1) except that, in the "Preparation of Polymerizable Monomer Composition for Core", the added amount of the mixed crystal of the magenta pigments of Production Example 1 was changed from 6.5 parts to 7.0 parts, and the C.I. Solvent Violet 59 was not used.

<Colored Resin Particles (7)>

Colored resin particles (7) were obtained in the same manner as the method for producing colored resin particles (1) except that, in the "Preparation of Polymerizable Monomer Composition for Core", 6.5 parts of the mixed crystal of the magenta pigments of Production Example 1 was changed to 3.0 parts of C.I. Pigment Red 146 (the following formula (X), CAS No. 5280-68-2, manufactured by Clariant, product name: Permanent Carmine FBB02), and the added amount of the C.I. Solvent Violet 59 was changed from 0.5 parts to 3.0 parts.

Formula (X)

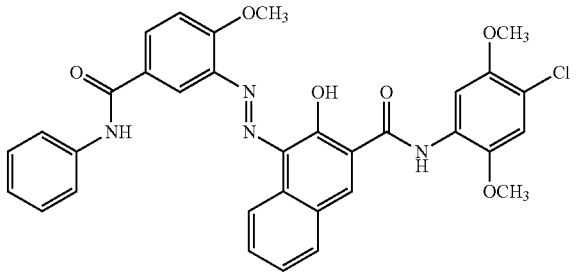

<Colored Resin Particles (8)>

Colored resin particles (8) were obtained in the same manner as the method for producing colored resin particles (1) except that, in the "Preparation of Polymerizable Monomer Composition for Core", 6.5 parts of the mixed crystal of the magenta pigments of Production Example 1 was changed to 4.0 parts of the C.I. Pigment Red 146 (the above formula (X), CAS No. 5280-68-2, manufactured by Clariant, product name: Permanent Carmine FBB02), and the added amount of the C.I. Solvent Violet 59 was changed from 0.5 parts to 3.0 parts.

3. Production of Magenta Toner

The colored resin particles (1) to (8) were subjected to an external addition treatment to produce magenta toners of Examples 1 to 5 and Comparative Examples 1 to 3.

Example 1

To 100 parts of the colored resin particles (1), 0.2 parts of hydrophobized silica fine particles with an average particle diameter of 7 nm, 1.0 part of hydrophobized silica fine particles with an average particle diameter of 22 nm, and 1.26 parts of hydrophobized silica fine particles with an average particle diameter of nm were added, and mixed using a high-speed mixing machine (manufactured by NIPPON COKE & ENGINEERING CO., LTD., product name: FM mixer) to prepare a magenta toner of Example 1.

Examples 2 to 5, Comparative Examples 1 to 3

Magenta toners of Examples 2 to 5 and Comparative Examples 1 to 3 were obtained in the same manner as in Example 1 except that the colored resin particles (1) were changed to any of the colored resin particles (2) to (8) as shown in Table 1 below.

4. Evaluation of Toner for Developing Electrostatic Images

For the magenta toners of Examples 1 to 5 and Comparative Examples 1 to 3, image density, chroma, fixing temperature (minimum fixing temperature), fog under a normal temperature and normal humidity (N/N) environment, and heat-resistant temperature and charge amount (blow-off charge amount) were measured as follows.

4-1. Measurement of Image Density and Chroma

A commercially-available color printer (printing rate: 20 sheets/min) of the non-magnetic one-component developing method was used. The toner cartridge of the development device was filled with a sample magenta toner, and printing sheets were loaded in the printer. Then, the printer was left for a whole day and night in an (N/N) environment at a temperature of 23° C. and a humidity of 50% RH. Then, while the amount of the toner supplied onto the developing roller in solid pattern printing was fixed at 0.30 mg/cm$^2$, sheets are continuously printed at an image density of 5%. Solid pattern printing (image density: 100%) was carried out on the tenth sheet. Using a McBeth transmitting image densitometer, the image density (ID) and chroma (C*) of the tenth sheet were measured. Image density is preferably 0.95 or more. Chroma is preferably 66.5 or more.

4-2. Minimum Fixing Temperature of Toner

A printer that was modified so that the temperature of a fixing roll part of a commercially available printer (a 24 sheets per minute printer; printing speed=24 sheets/min) of the non-magnetic one-component developing method could be changed was used. The temperature of the fixing roll was changed, the fixing rate at each temperature was measured, a relationship between the temperature and the fixing rate was determined, and the lowest temperature at which a fixing rate of 80% or more was obtained was defined as the minimum fixing temperature.

The fixing rate was calculated from the image density ratio before and after a rubbing test operation of a black solid area on a test paper printed by the printer. That is, when the image density before the rubbing test is ID (before) and the image density after the rubbing test is ID (after), the fixing rate (%)=[ID (after)/ID (before)]×100. Here, the black solid area is an area controlled so that a developer adheres to all of dots (virtual dots for controlling a printer control unit) within the area. The rubbing test operation is a series of operations in which a measurement part for a test paper is attached to a fastness tester with an adhesive tape, a 500 g load is applied, and a reciprocating rubbing is performed 5 times with a rubbing terminal wrapped with a cotton cloth.

4-3. Measurement of Fog in Normal Temperature and Normal Humidity (N/N) Environment A commercially-available printer of the non-magnetic one-component developing method and the toner to be evaluated were left for a whole day and night in a normal temperature and normal humidity (N/N) environment at a temperature of 23° C. and a humidity of 50% RH.

The fog measurement was performed in the following manner. First, the color tone of a printing sheet unused for printing was measured, and this color tone was used as a reference value ($E_0$). Next, the toner was used to perform white solid printing on the printing sheet with the same printer as "4-1. Measurement of Image density and Chroma". The hues ($E_1$ to $E_6$) of arbitrary 6 points on the white solid pattern were measured. A color difference (ΔE) between each of the hues ($E_1$ to $E_6$) and the reference ($E_0$) was calculated. The largest color difference ΔE was used as the fog value of the toner, and evaluated as follows. A smaller fog value means less fog and better printing. The hues were measured by means of a spectrophotometer (manufactured by X-Rite Incorporated, product name: SpectroEye).

A: the ΔE is less than 0.5,

B: the ΔE is 0.5 or more, and less than 1.5, or

F: the ΔE is 1.5 or more.

4-4. Heat-Resistant Temperature of Toner 10 g of a toner was placed in a 100 mL polyethylene container and the container was sealed. Then, the container was set in a constant temperature water bath which was set to a predetermined temperature. After 8 hours, the container was removed from the constant temperature water bath. The toner was transferred from the removed container to a 42-mesh sieve in a manner preventing vibration as much as possible, then was set in a powder characteristic tester (manufactured by Hosokawa Micron Corporation, product name: POWDER TESTER PT-R). The condition of amplitude of the sieve was set to 1.0 mm, the sieve was vibrated for 30 seconds, and the mass of the toner remained on the sieve was measured and the thus-measured toner was referred to as an aggregated toner mass.

The maximum temperature at which the aggregated toner mass becomes 0.5 g or less was determined as the heat-resistant temperature of the toner.

4-5. Blow-off Charge Amount

Under a normal temperature and normal humidity (N/N) environment of a temperature of 23° C. and a humidity of 50% RH, 9.5 g of a carrier (manufactured by Powdertech Co., Ltd., product name: EF80B2, Mn—Mg—Sr soft ferrite, average particle size 80 μm, particle size distribution 50 to 100 μm) and 0.5 g of a toner were weighed, placed in a glass container with a volume of 30 mL and rotated at 150 rpm for 30 minutes to frictionally charge toner particles. The obtained carrier and toner particles were blown off with nitrogen gas at a pressure of 1 kg/cm$^2$ with a blow-off meter (manufactured by Toshiba Chemical Corporation, product name: TB-200), and the blow-off charge amount of the toner was measured.

Table 1 shows the measurement and evaluation results of the magenta toners of Examples 1 to 5 and Comparative Examples 1 to 3, along with each toner composition.

Incidentally, in the following Table 1, "PR122" represents C.I. Pigment Red 122, "PV19" represents C.I. Pigment Violet 19, "SV59" represents C.I. Solvent Violet 59, "SV31" represents C.I. Solvent Violet 31, "PR146" represents C.I. Pigment Red 146, respectively. "(PR122+PV19)/compound A" represents the mass ratio of the total content of the C.I. Pigment Red 122 and the C.I. Pigment Violet 19 to the content of the compound A (C.I. Solvent Violet 59 or C.I. Solvent Violet 31).

less. Therefore, it can be seen that when the C.I. Solvent Violet 59 and the C.I. Pigment Red 146 are combined, the chroma (C*) is low and shelf stability is poor.

Further, comparing Comparative Example 2 and Comparative Example 3, Comparative Example 3 containing more C.I. Pigment Red 146 by 1.0 part has a further lower chroma (C*) of 58.5 and a further lower heat resistant temperature of 53° C. Therefore, it can be seen that in the combination of the C.I. Solvent Violet 59 and the C.I. Pigment Red 146, the higher the ratio of the C.I. Pigment Red 146, the lower the chroma (C*) and the poorer the shelf stability.

On the other hand, the magenta toners of Examples 1 to 5 contain the C.I. Pigment Red 122 and the C.I. Pigment Violet 19 as a magenta colorant, and the C.I. Solvent Violet 59 or the C.I. Solvent Violet 31 as the compound A. In addition, the magenta toners of Examples 1 to 5 contain, with respect to 100 parts by mass of the binder resin, a total of from 6.0 to 7.0 parts by mass of the C.I. Pigment Red 122,

TABLE 1

| Colored resin particles | | Example 1 Particles (1) | Example 2 Particles (2) | Example 3 Particles (3) | Example 4 Particles (4) | Example 5 Particles (5) | Comparative Example 1 Particles (6) | Comparative Example 2 Particles (7) | Comparative Example 3 Particles (8) |
|---|---|---|---|---|---|---|---|---|---|
| Mixed crystal of PR122 and PV19 (parts) | | 6.5 | 5.5 | 4.5 | — | 6.5 | 7.0 | — | — |
| PR122 (parts) | | — | — | — | 3.0 | — | — | — | — |
| PV19 (parts) | | — | — | — | 3.0 | — | — | — | — |
| Compound A | SV59 (parts) | 0.5 | 1.0 | 1.5 | 1.0 | — | — | 3.0 | 3.0 |
| | SV31 (parts) | — | — | — | — | 0.5 | — | — | — |
| PR146 (parts) | | — | — | — | — | — | — | 3.0 | 4.0 |
| Total added amount of colorants (parts) | | 7.0 | 6.5 | 6.0 | 7.0 | 7.0 | 7.0 | 6.0 | 7.0 |
| (PR122 + PV19)/compound A | | 13 | 5.5 | 3.0 | 6.0 | 13 | — | — | — |
| Evaluation results | M/A (mg/cm2) | 0.30 | 0.30 | 0.30 | 0.30 | 0.30 | 0.30 | 0.30 | 0.30 |
| | ID | 1.00 | 0.96 | 1.00 | 0.96 | 1.02 | 0.99 | 0.96 | 0.99 |
| | Chroma | 68.5 | 67.8 | 68.0 | 66.7 | 67.8 | 66.4 | 60.3 | 58.5 |
| | Minimum fixing temperature (° C.) | 145 | 145 | 140 | 145 | 145 | 150 | 140 | 140 |
| | NN fog | A | A | A | A | A | B | A | A |
| | Heat-resistant temperature (° C.) | 57 | 57 | 56 | 57 | 56 | 57 | 54 | 53 |
| | Blow-off charge amount (μC/g) | 73.5 | 75.0 | 74.3 | 74.1 | 72.5 | 64.4 | 74.2 | 73.4 |

5. Summary of Toner Evaluation

The magenta toner of Comparative Example 1 is a toner using only a mixed crystal of the C.I. Pigment Red 122 and the C.I. Pigment Violet 19 as a magenta colorant. In Comparative Example 1, the chroma (C*) is as low as 66.4, the minimum fixing temperature is as high as 150° C., fog evaluation under the N/N environment is B, and the blow-off charge amount is as small as 64.4 μC/g. The minimum fixing temperature of Comparative Example 1 is the highest among the toners evaluated this time. Moreover, the fog evaluation under the N/N environment of Comparative Example is the lowest among the toners evaluated this time. Further, the blow-off charge amount of Comparative Example 1 is the smallest among the toners evaluated this time. Therefore, it can be seen that when only the mixed crystal is used, the charge amount of the toner is insufficient and thus fog is likely to occur, further, the chroma (C*) is low and low-temperature fixability is poor.

The magenta toners of Comparative Examples 2 and 3 are toners using the C.I. Solvent Violet 59 and the C.I. Pigment Red 146 in combination as a magenta colorant. In Comparative Examples 2 and 3, the chroma (C*) is as low as 60.3 or less, and heat-resistant temperature is as low as 54° C. or the C.I. Pigment Violet 19 and the C.I. Solvent Violet 59, and a mass ratio of a total content of the C.I. Pigment Red 122 and the C.I. Pigment Violet 19 to a content of the compound A (the C.I. Solvent Violet 59 or the C.I. Solvent Violet 31) {(PR122+PV19)/the compound A} is from 3.0 to 13.

The toners of Examples 1 to 5 exhibit both a high image density of 0.96 or more and a high chroma (C*) of 66.7 or more. Also, the toners of Examples 1 to 5 have a minimum fixing temperature of 145° C. or less and a heat resistant temperature of 56° C. or more, and are excellent in both low-temperature fixability and shelf stability. Further, the toners of Examples 1 to 5 have a large blow-off charge amount of 72.5 μC/g or more and exhibit sufficient charging ability, thus fog evaluation under the N/N environment is also high, and fog is not likely to occur.

Moreover, since pigments of the C.I. Pigment Red 122 and the C.I. Pigment Violet 19 having higher chroma than conventional pigments and the compound A having an anthraquinone skeleton and higher chroma than conventional compounds are combined, the added amount of the colorant can be reduced as compared to conventional magenta colorants. As a result, the toners of Examples 1 to 5 can be produced at lower cost than conventional toners.

Therefore, the magenta toners of Examples 1 to 5 in which the magenta toners contain the C.I. Pigment Red 122, the C.I. Pigment Violet 19 and the compound A represented by the general formula (1) as a magenta colorant, and in which, with respect to 100 parts by mass of the binder resin, a total of from 3 to 30 parts by mass of the C.I. Pigment Red 122, the C.I. Pigment Violet 19 and the compound A are contained, and a mass ratio of a total content of the C.I. Pigment Red 122 and the C.I. Pigment Violet 19 to a content of the compound A {(PR122+PV19)/the compound A} is from 1 to 20, exhibit high image density and chroma, have excellent low-temperature fixability, shelf stability and charging ability, are unlikely to fog, and can be produced at low cost.

The invention claimed is:

1. A magenta toner comprising a binder resin and a magenta colorant, wherein the magenta toner comprises C.I. Pigment Red 122, C.I. Pigment Violet 19 and a compound A represented by the following general formula (1) as the magenta colorant, and wherein, with respect to 100 parts by mass of the binder resin, a total of from 3 to 30 parts by mass of the C.I. Pigment Red 122, the C.I. Pigment Violet 19 and the compound A are contained, and a mass ratio of a total content of the C.I. Pigment Red 122 and the C.I. Pigment Violet 19 to a content of the compound A {(PR122+PV19)/the compound A} is from 1 to 20:

General Formula (1)

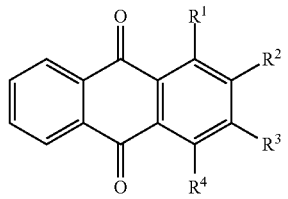

wherein $R^1$ and $R^4$ are each independently an amino group or a hydroxyl group, and $R^1$ and $R^3$ are each independently a hydrogen atom, a halogen atom, or a substituted or unsubstituted phenoxy group ($—OC_6H_5$).

2. The magenta toner according to claim 1, wherein the magenta colorant comprises a mixed crystal of the C.I. Pigment Red 122 and the C.I. Pigment Violet 19, and the compound A.

3. The magenta toner according to claim 1, wherein the compound A is C.I. Solvent Violet 59.

* * * * *